US006095860A

United States Patent [19]

Gehrke et al.

[11] Patent Number: 6,095,860

[45] Date of Patent: Aug. 1, 2000

[54] ELECTRICAL CONNECTOR WITH A FAMILY SEAL, AND FAMILY SEAL

[75] Inventors: Horst Gehrke, Langen; Ralf Jaklin, Liederbach, both of Germany

[73] Assignee: The Whitaker Corporation, Wilmington, Del.

[21] Appl. No.: 09/367,596

[22] PCT Filed: Feb. 12, 1998

[86] PCT No.: PCT/IB98/00173

§ 371 Date: Aug. 18, 1999

§ 102(e) Date: Aug. 18, 1999

[87] PCT Pub. No.: WO98/37597

PCT Pub. Date: Aug. 27, 1998

[30] Foreign Application Priority Data

Feb. 19, 1997 [EP] European Pat. Off. ..... 97102672

[51] Int. Cl.[7] ..... H01R 13/40

[52] U.S. Cl. ..... 439/587; 439/589; 439/274

[58] Field of Search ..... 439/587, 589, 439/271, 272, 274, 275, 279, 281

[56] References Cited

U.S. PATENT DOCUMENTS

| | | | |
|---|---|---|---|
| 4,998,896 | 3/1991 | Lundergan | 439/274 |
| 5,145,410 | 9/1992 | Maejima et al. | 439/587 |
| 5,571,032 | 11/1996 | Sano et al. | 439/589 |
| 5,676,373 | 10/1997 | Sakai et al. | 439/271 |
| 5,707,251 | 1/1998 | Sakai et al. | 439/274 |
| 5,766,039 | 6/1998 | Abe | 439/587 |

FOREIGN PATENT DOCUMENTS

| | | |
|---|---|---|
| 0 335 721-A2 | 10/1989 | European Pat. Off. . |
| 0 732 733-A2 | 9/1996 | European Pat. Off. . |
| 2 280 794 | 2/1995 | United Kingdom . |

*Primary Examiner*—Gary F. Paumen
*Assistant Examiner*—Tho D. Ta

[57] ABSTRACT

An electrical connector with a family seal and a connector housing, which has an outer collar and at least one chamber for an electrical contact the chamber surrounded by an outer rim between the two collars and a plate-like region with at least one through-opening located inside the inner collar, the outer rim and the plate-like region being connected to each other by a connecting plate, which extends over the inner collar.

11 Claims, 3 Drawing Sheets

ELECTRICAL CONNECTOR WITH A FAMILY SEAL, AND FAMILY SEAL

BACKGROUND OF THE INVENTION

1. Field of the Invention

The invention relates to an electrical connector with a family seal and a connector housing, which has an outer collar and at least one chamber for a contact, the open end of the chamber, on the cable side, lies inside the outer collar, the family seal having at least one through-opening for introducing a contact into the corresponding chamber. The invention also relates to a family seal for such an electrical connector.

2. Summary of the Prior Art

The use of family seals for sealing the conductors attached to contacts in connector housings is widely known. The family seals thereby provided seal with respect to each individual conductor which is connected to a contact and with respect to the housing collar. A number of problems have occurred with the use of such seals.

From EP 335 721-A2 a water proof electric connector is known. Disclosed is an improved water proof electric connector structure which uses a rubber gasket to be sandwiched between a cap and a housing. The rubber gasket is used as a family seal and has an outer limit to permit the complementary outer limit of the inner surface of the housing to fit in.

U.S. Pat. No. 5,145,410 discloses, for example, the introduction of a family seal into a receptacle which is divided into a grid-like network by cross plates. This ensures that the through-openings of the family seal are not displaced with respect to the ends of the chambers for the electrical contacts as soon as some individual contacts are introduced.

SUMMARY OF THE INVENTION

A further problem is that, if an increased contact pressure of the family seal to the peripheral housing collar is desired, this increased contact pressure has the result that the inner sealing lips of the through-openings are damaged when contacts are pushed through. Such damage must be avoided, however, to achieve a good sealing effect.

It is the object of the invention to specify an electrical connector with a family seal where the probability of damaging the inner sealing lips is reduced in spite of an optimized contact pressure of the family seal against the housing collar.

The object is achieved by an electrical connector with a family seal having the features of patent claim 1.

Advantageous developments are specified in the subclaims.

The object of the invention is achieved by separating from each other the two sealing effects which are achieved by the family seal, to on the one hand seal with respect to the outer collar of the plug housing and on the other hand with respect to the conductors which are fitted to the contacts. This is accomplished by the family seal being provided with an outer rim which is connected only by means of a connecting plate to the plate-like region which has the through-openings for sealing the conductors. As a result, an increased pressure on the outer collar does not likewise act in the region of the through-openings.

To obtain a particularly good seal with respect to the outer collar, the outer rim of the family seal has on its outside wall at least one sealing lip. An additional, inner collar is arranged on the connector housing, and the contact pressure of the family seal on the outer housing collar is ensured by this inner collar. The outer rim of the family seal is located between the inner collar and the outer collar. Although the sealing effects are separated from each other, the two sealing parts, outer rim and plate-like region, are still connected to each other. Thus, no additional opening which has to be sealed is produced. The connecting plate extends over the inner collar.

To establish a stable connection between the outer rim and the pate-like region of the family seal, it is possible to provide stabilizing pieces, which connect the two to each other. Correspondingly, the inner collar has recesses which receive these stabilizing pieces. Even when the inner collar is not completely closed, the desired effect is still achieved as long as the collar can exert adequate pressure on the outer rim of the family seal and on the outer collar. The plate-like region of the family seal may, in principle, look like any customary family seal.

It is particularly advantageous, however, if the family seal has one or two rows of through-openings. This is because there is a distance between the outside wall of the plate-like region of the family seal and the inner collar. This distance is not filled, but contains only air. If a contact is introduced through a through-opening, the family seal has the possibility of expanding in this free region. This is, of course, particularly meaningful whenever each through-opening is arranged directly alongside such a free region, which is only the case if there is a two-row or even one-row arrangement.

DETAILED DESCRIPTION OF THE PREFERRED EMBODIMENT

Figure 1:
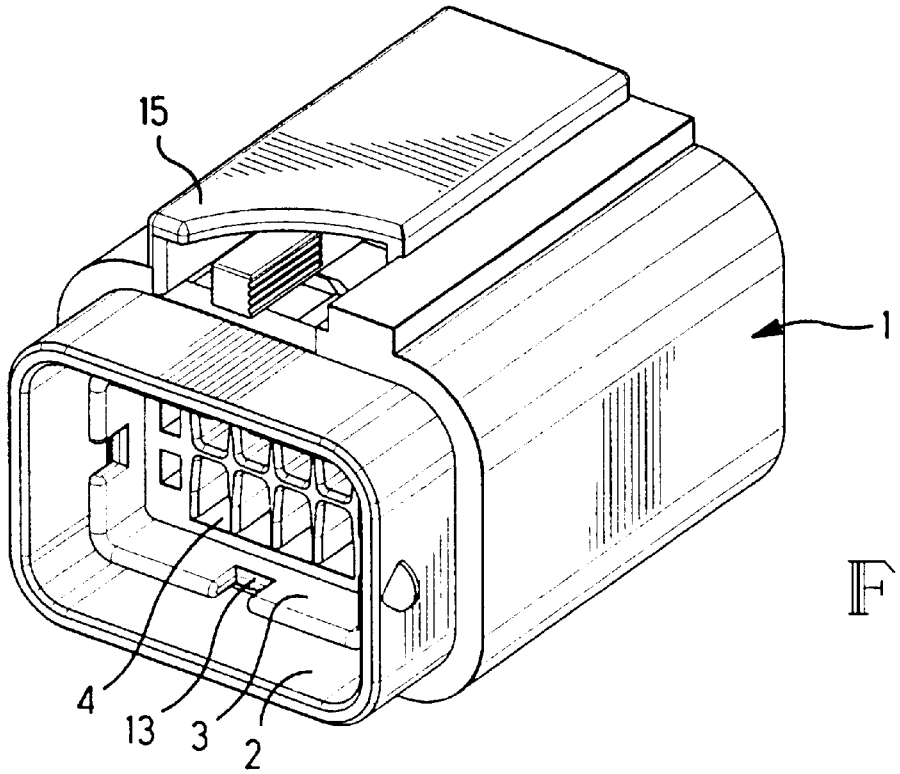
FIG. 1 shows a perspective view of a connector housing.

FIG. 1 shows a connector housing 1 of a sealed plug-in connector. At the end on the cable side, the connector housing 1 has an outer collar 2. Inside the outer collar 2 there is a further, inner collar 3. Inside the inner collar 3 there are two rows of four chambers 4 in each row, which serve for receiving electrical contacts. The open ends of the chambers, on the cable side, all lie inside the inner collar 3 and consequently inside the outer collar 2. Furthermore, the connector housing 1 has a locking device 15, for interlocking with a complementary connector housing.

Figure 2:
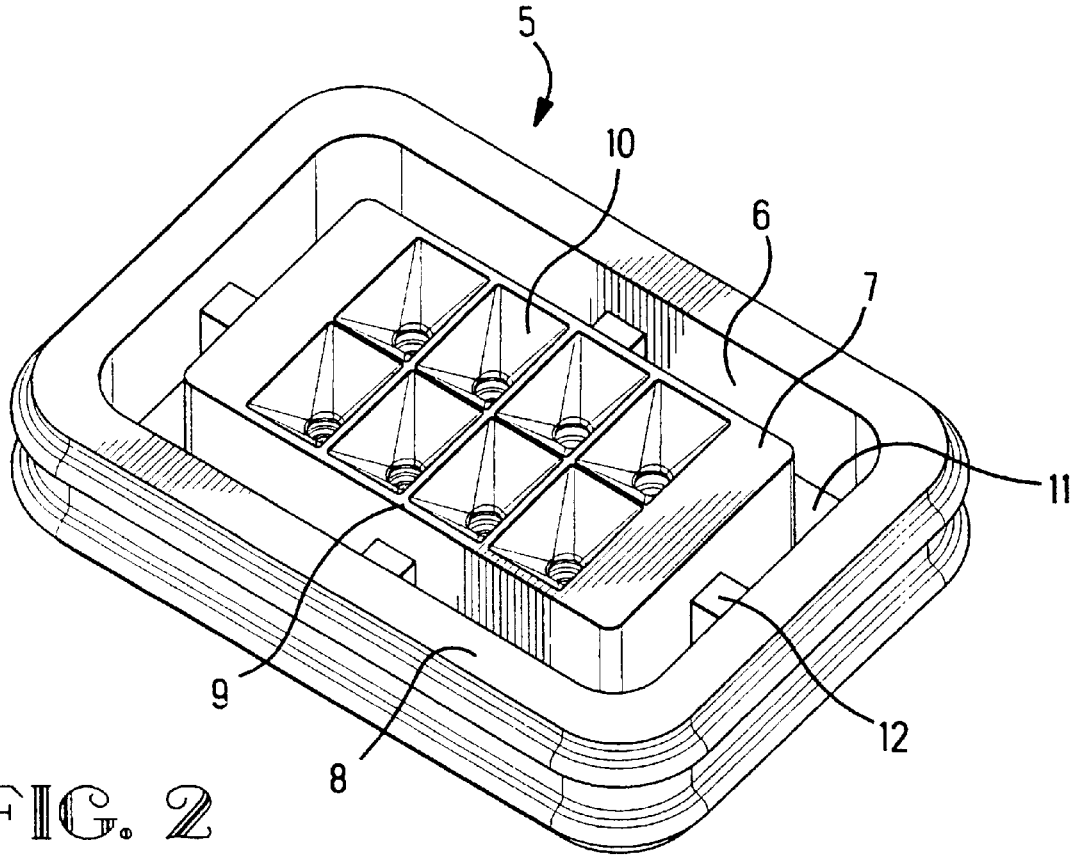
FIG. 2 shows a perspective view of a family seal.

In FIG. 2, a family seal 5 is represented. The family seal 5 is of a substantially plate-like design. This plate has, however, on one of its surfaces 7 a peripheral groove 6, which separates an outer rim 8 from a plate-like inner region 9. The plate-like inner region 9 of the family seal 5 has two rows of in each case four through-openings 10. The groove 6 is only of such a depth that there remains on the surface area lying opposite the surface area 7 a connecting plate 11, which connects the plate-like inner region 9 to the outer rim 8. To achieve adequate stability between the outer rim and the plate-like inner region 9, between the latter there are stabilizing pieces 12, which strengthen the connecting plate at some points. It can be seen from FIG. 1 that the inner collar 3 has recesses 13, which serve for receiving the stabilizing pieces.

Figure 3:
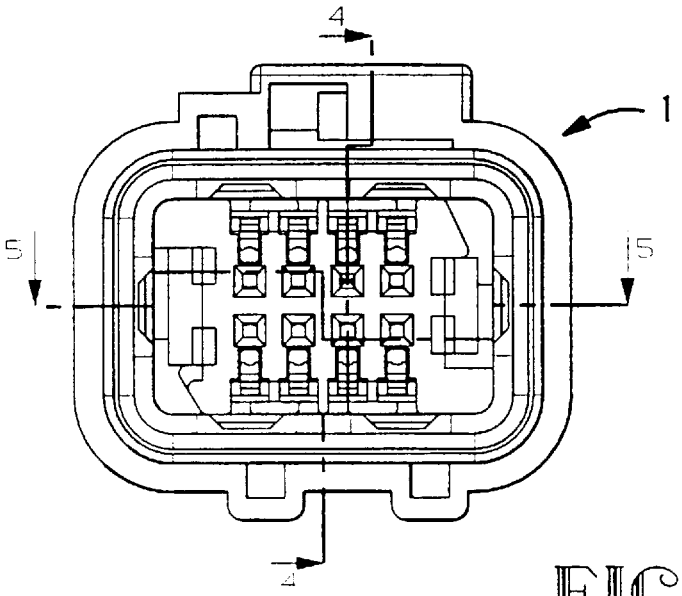
FIG. 3 shows a plan view of the corresponding connector housing.
Figure 4:
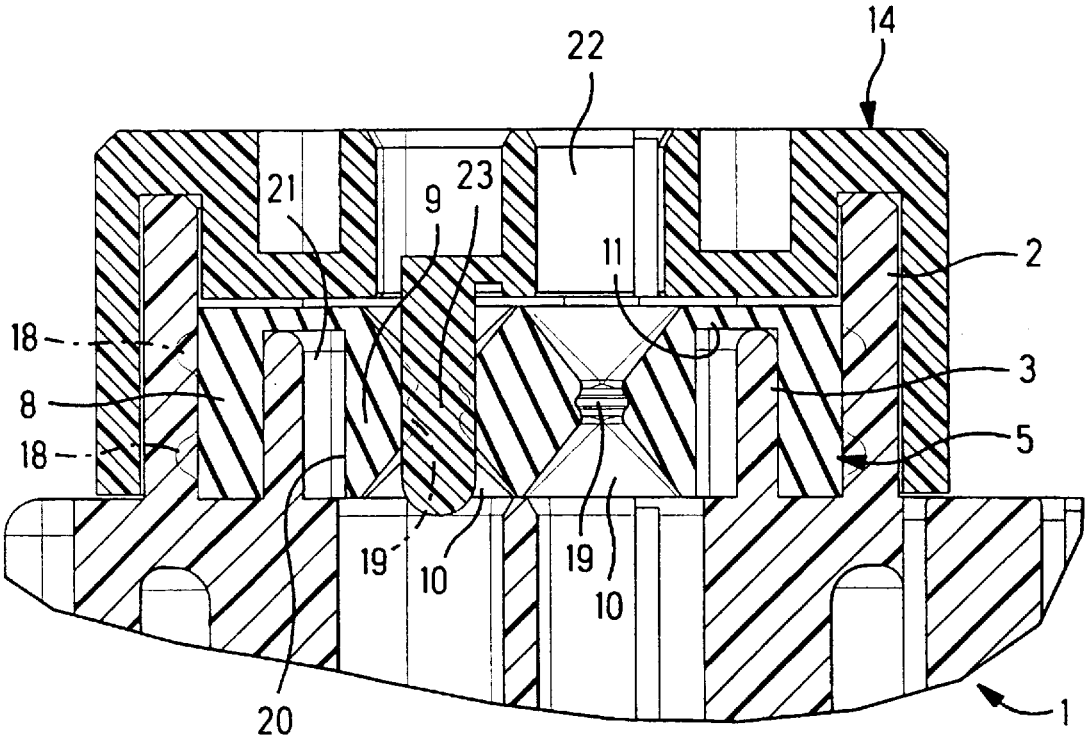
FIG. 4 shows a cross-section along the line 4—4 of FIG. 3 through the connector housing with a family seal inserted and a covering cap fitted.
Figure 5:
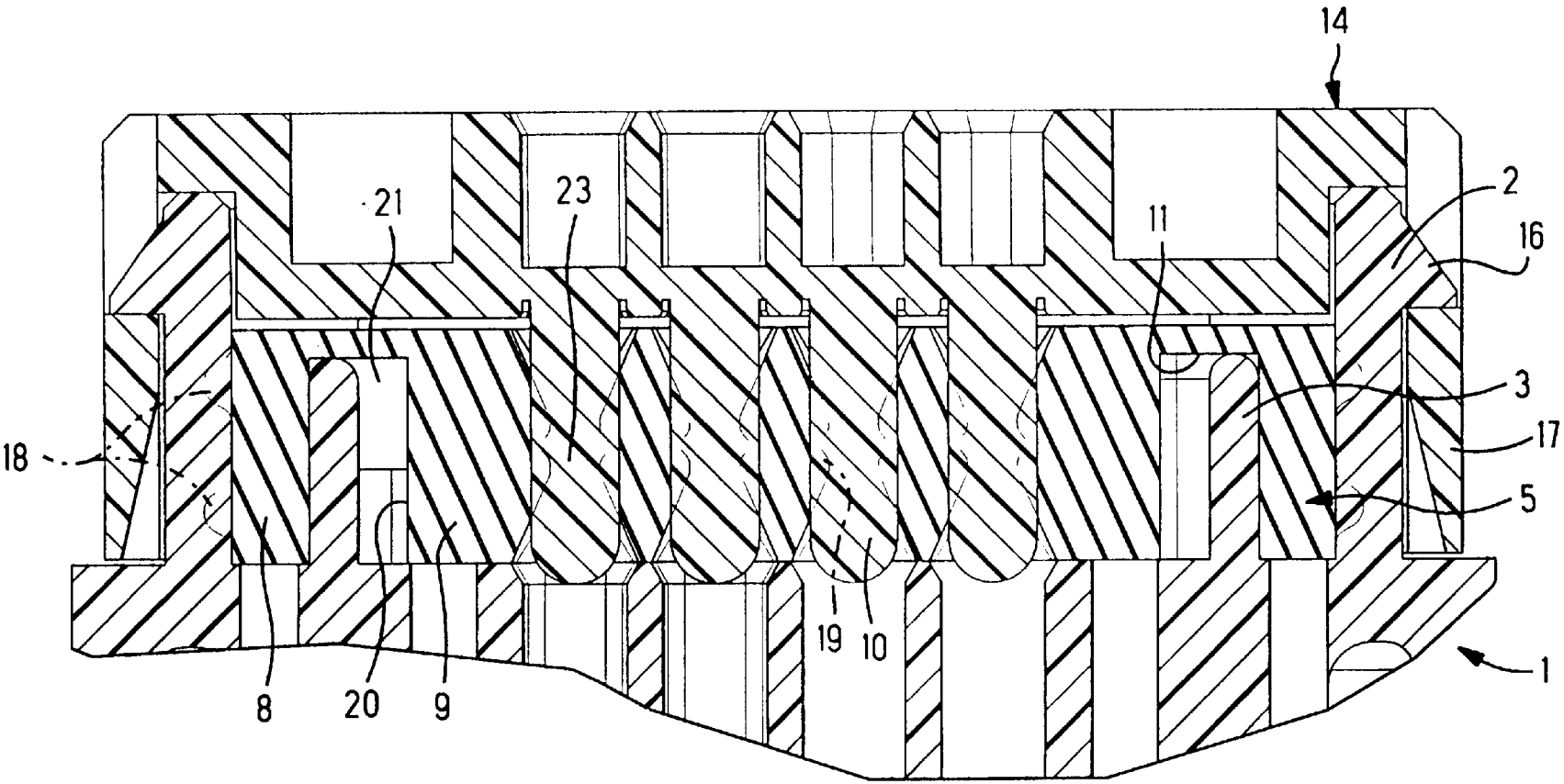
FIG. 5 shows a cross-section along the line 5—5 of FIG. 3 through the corresponding connector housing with family seal and covering cap.

In the plan view according to FIG. 3, the connector housing 1 is once again represented. In particular, it is indicated how the sections according to FIGS. 4 and 5 were formed. In FIGS. 4 and 5, the corresponding cross-sections are represented. Easy to distinguish from one another is the connector housing 1, on the one hand, and the family seal 5 and a covering cap 14, on the other hand.

It can be seen in FIG. 5 that the covering cap 14 is interlocked with the connector housing 1. Corresponding locking hooks and locking arms 16, 17 are provided. The construction of the family seal 5 can then be clearly seen from FIGS. 4 and 5. The family seal 5 has a plate-like inner region 9, and also an outer rim 8. On its outside walls, the outer rim has two sealing lips 18. Furthermore, the seal has a connecting plate 11, by which the outer rim 8 is connected to the inner region 9. The inner region 9 has the through-openings 10. As can be seen particularly clearly in the section, the through-openings are of a double-pyramid-shaped design, with a rectangular base area, the points of the pyramids touching one another. In the region of the points of the pyramids there are in the through-openings inner sealing lips 19, which correspondingly ensure the sealing around a conductor. As can be seen from FIGS. 4 and 5, the connector housing has an outer collar 2 and an inner collar 3. Between the outer collar 2 and the inner collar 3 is the outer rim 8 of the family seal 5. The sealing pressure exerted on the outer collar 2 is absorbed by the inner collar 3. Consequently, the inner region 8 of the family seal 5 is relieved of this sealing pressure. In addition, it can be seen in the figures that there is a free space 21 between the inner collar 3 and the outside wall 20 of the plate-like inner region 9. The inner collar 3 and the outside wall of the plate-like inner region 9 of the family seal are thus arranged at a distance from each other. It is ensured by the additional free space 21 that the seal 5 can expand when contacts are pushed through. The covering cap 14 serves for protecting the family seal 5 and as a guide for the contacts which are introduced through the family seal into the connector housing 1. It has through-bores 22 corresponding to this purpose. Furthermore, it has pins 23, which engage in corresponding through-openings 10 of the family seal 5. This takes place only for those contact chambers which are not to be occupied with contacts and serves for sealing the system. The sealing lips 19 correspondingly seal the system at the pins 23 in the same way as at an introduced conductor.

What is claimed is:

1. An electrical connector comprising a family seal and a connector housing having an outer collar and at least one chamber for an electrical contact, with an open end on a cable side inside the outer collar, the family seal being inserted in a receptacle that is defined by the outer collar and has at least one through-opening for introducing the electrical contact into the corresponding chamber, characterized in that inside the outer collar there is an inner collar, inside of which are the open ends of the chambers where the family seal has an outer rim, disposed between the two collars, and a plate-like region with the at least one through-opening located inside the inner collar, the outer rim and the plate-like region being connected to each other by a connecting plate that extends over the inner collar.

2. The electrical connector according to claim 1, wherein the family seal has at least one sealing lip on an outside wall of the outer rim.

3. The electrical connector according to claim 1, wherein the family seal has stabilizing pieces between the plate-like region and the outer rim and the inner collar has recesses for receiving the stabilizing pieces.

4. The electrical connector according to claim 1, wherein the through-openings of the family seal look in cross-section like two pyramids placed with the points one on top of the other, sealing lips being located in the region between the pyramids.

5. The electrical connector according to claim 1, wherein the thickness of the outer rim and plate-like region correspond to each other, while the thickness of the connecting plate is small in comparison thereto.

6. The electrical connector according to claim 1, wherein the connector housing having a locking device on an outside wall for interlocking with a complementary plug.

7. The electrical connector according to claim 1, characterized in a free space exists between the inner collar of the connector housing and a side wall of the plate-like region of the family seal.

8. The electrical connector according to claim 7, wherein the inner collar has interruptions so that the inner collar is not closed on all sides.

9. The electrical connector according to claim 1, wherein a covering cap having appropriate through-bores for contacts, is fitted onto the outer collar.

10. The electrical connector according to claim 9, wherein the covering cap interlocks with the connector housing.

11. The electrical connector according to claim 9, wherein the covering cap has pins, for closing the unoccupied through-openings in the family seal.

* * * * *